US009042784B2

(12) United States Patent
Matsuda et al.

(10) Patent No.: US 9,042,784 B2
(45) Date of Patent: May 26, 2015

(54) ROTATING-BODY DRIVING DEVICE AND IMAGE FORMING APPARATUS

(71) Applicants: Hiromichi Matsuda, Kanagawa (JP); Katsuaki Miyawaki, Kanagawa (JP); Tetsuo Watanabe, Kanagawa (JP); Yasuhiro Maehata, Tokyo (JP); Keisuke Shimizu, Tokyo (JP)

(72) Inventors: Hiromichi Matsuda, Kanagawa (JP); Katsuaki Miyawaki, Kanagawa (JP); Tetsuo Watanabe, Kanagawa (JP); Yasuhiro Maehata, Tokyo (JP); Keisuke Shimizu, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 13/971,932

(22) Filed: Aug. 21, 2013

(65) Prior Publication Data

US 2014/0056618 A1 Feb. 27, 2014

(30) Foreign Application Priority Data

Aug. 23, 2012 (JP) ..... 2012-183938

(51) Int. Cl.
*G03G 15/00* (2006.01)

(52) U.S. Cl.
CPC ..... *G03G 15/757* (2013.01)

(58) Field of Classification Search
USPC ..... 399/167; 475/331, 346
See application file for complete search history.

(56) References Cited

U.S. PATENT DOCUMENTS

| | | | | |
|---|---|---|---|---|
| 7,606,516 | B2 * | 10/2009 | Ueda et al. | 399/167 |
| 8,160,463 | B2 * | 4/2012 | Takahashi et al. | 399/36 |
| 2007/0009290 | A1 * | 1/2007 | Okabe | 399/302 |
| 2007/0122194 | A1 * | 5/2007 | Imai | 399/167 |
| 2007/0231009 | A1 | 10/2007 | Watahiki | |
| 2007/0248383 | A1 * | 10/2007 | Ueda et al. | 399/167 |
| 2008/0213001 | A1 * | 9/2008 | Ueda et al. | 399/167 |
| 2008/0231223 | A1 * | 9/2008 | Imai et al. | 318/683 |
| 2009/0162118 | A1 | 6/2009 | Noguchi et al. | |
| 2009/0324262 | A1 | 12/2009 | Matsuda et al. | |
| 2011/0026969 | A1 * | 2/2011 | Maeda | 399/167 |
| 2011/0280627 | A1 * | 11/2011 | Matsuda | 399/167 |
| 2011/0293328 | A1 * | 12/2011 | Matsuda et al. | 399/167 |
| 2013/0109529 | A1 * | 5/2013 | Maehata et al. | 475/345 |

FOREIGN PATENT DOCUMENTS

| | | |
|---|---|---|
| JP | 02-043574 | 2/1990 |
| JP | 2754582 | 3/1998 |
| JP | 2000-050662 | 2/2000 |
| JP | 3259440 | 12/2001 |
| JP | 2007-052069 | 3/2007 |
| JP | 2007-256308 | 10/2007 |
| JP | 2008-099490 | 4/2008 |
| JP | 2009-153250 | 7/2009 |
| JP | 2010-008924 | 1/2010 |

* cited by examiner

*Primary Examiner* — Francis Gray
(74) *Attorney, Agent, or Firm* — Harness, Dickey & Pierce, P.L.C.

(57) ABSTRACT

A rotating-body driving device that includes a rotating body; a driving source; a reduction gear that includes an output shaft and a gear rotating at a non-integer ratio of rotation period to a rotation period of the output shaft, and the reduction gear reducing rotation speed of the driving source; a pulse-signal generating unit; a pulse-count storage unit; a speed-fluctuation storage unit that stores therein a rotation speed fluctuation of the output shaft; and a driving-source control unit. The driving-source control unit detects the speed fluctuation information associated with the accumulated number of pulse signals from the speed-fluctuation storage unit, and performs for the driving source a feedforward control to set off the rotation speed fluctuation.

10 Claims, 9 Drawing Sheets

FIG.6

| | OUTPUT SIDE | | | INPUT SIDE | | |
|---|---|---|---|---|---|---|
| | SECOND SUN GEAR | SECOND PLANETARY GEARS | OUTER GEAR | FIRST SUN GEAR | FIRST PLANETARY GEARS | OUTER GEAR |
| NUMBER OF TEETH | 25 | 27 | 79 | 13 | 33 | 79 |
| NUMBER OF PLANETARY GEARS | 3 | | | 3 | | |
| REDUCTION GEAR RATIO | 4.16 | | | 7.08 | | |
| MODULE | 0.4 | | | 0.4 | | |
| FACE WIDTH [mm] | 10 | | | 10 | | |
| PRESSURE ANGLE [deg] | 20 | | | 20 | | |
| HELIX ANGLE [deg] | 12 | | | 12 | | |
| ADDENDUM MODIFICATION COEFFICIENT | 0 | 0 | 0 | 0 | 0 | 0 |
| CENTER DISTANCE [mm] | 10.632 | | | 9.405 | | |
| REFERENCE PITCH CIRCLE | 10.223 | 11.041 | 32.306 | 5.316 | 13.495 | 32.306 |
| ADDENDUM CIRCLE DIAMETER | 11.023 | 11.841 | 31.506 | 6.116 | 14.295 | 31.506 |
| ROOT CIRCLE DIAMETER | 9.223 | 10.041 | 33.306 | 4.316 | 12.495 | 33.306 |
| CONTACT RATIO | 3.122 | - | 3.326 | 3.002 | - | 3.342 |

FIG.7

| ROTATION FLUCTUATION FACTOR | FREQUENCY [Hz] |
|---|---|
| FIRST STAGE | |
| FIRST SUN GEAR | 29.30 |
| FIRST PLANETARY GEAR | 9.91 |
| FIRST CARRIER | 4.14 |
| ONE TOOTH CONTACT | 327 |
| SECOND STAGE | |
| SECOND SUN GEAR | 4.14 |
| SECOND PLANETARY GEAR | 2.91 |
| SECOND CARRIER | 1.00 |
| ONE TOOTH CONTACT | 78.6 |

ROTATING-BODY DRIVING DEVICE AND IMAGE FORMING APPARATUS

CROSS-REFERENCE TO RELATED APPLICATIONS

The present application claims priority to and incorporates by reference the entire contents of Japanese Patent Application No. 2012-183938 filed in Japan on Aug. 23, 2012.

BACKGROUND OF THE INVENTION

1. Field of the Invention

The present invention relates to a rotating-body driving device for driving a rotating body and an image forming apparatus, such as a copier, a printer, or a facsimile machine, equipped with the rotating-body driving device.

2. Description of the Related Art

In general, as a color image forming apparatus, there is known, for example, a direct transfer method of tandem-type image forming apparatus that forms a color image on a recording medium by transferring solid black (Bk), yellow (Y), magenta (M), and cyan (C) images formed on photosensitive drums onto the recording medium being carried/conveyed on a recording-medium conveyance belt in a superimposed manner.

In such a tandem-type image forming apparatus, generally, a motor provided as a driving source of a photosensitive drum and a reduction gear unit are installed in the main body side of the image forming apparatus, and the reduction gear unit is connected to the photosensitive drum so as to transmit a driving force to the photosensitive drum.

Furthermore, in the tandem-type image forming apparatus, the quality of an image is greatly affected by the accuracy of surface moving speed of each photosensitive drum. Respective transfer positions of solid color images on the photosensitive drums are relatively shifted by fluctuation in surface moving speed which periodically occurs in the individual photosensitive drums. This causes a color shift of a color image formed on a recording medium or a so-called "banding phenomenon", density unevenness that periodically appears like strips, in a range of the color image formed.

Such fluctuation in surface moving speed is caused by an error in transmission of a drive transmission system installed on a shaft of a photosensitive drum (a transmission error due to gear eccentricity or cumulative tooth pitch deviation, and the like) and a transmission error due to a coupling provided to removably attach the photosensitive drum to the drive transmission system (axial tilt, shaft misalignment, and the like).

The periodic fluctuation in surface moving speed occurs with a rotation period of the shaft, a rotation period of gears, and a rotation period of a higher-order component, and constantly occurs in a driving state. Furthermore, the magnitude of the periodic fluctuation in surface moving speed varies according to the progression of gear wear with time or changes in installation conditions, such as a hygrothermal environment, of the image forming apparatus. Therefore, to correct the color shift, it is necessary to suppress the periodic fluctuation in surface moving speed of the photosensitive drums that varies with time and environment.

For example, Japanese Patent No. 2754582, Japanese Patent No. 3259440, and Japanese Patent Application Laid-open No. 2008-099490 have disclosed a technology of detecting an angular velocity of a shaft of a photosensitive drum when a drive motor is rotated at a predetermined constant angular velocity with a rotary encoder, storing information on fluctuation in angular velocity of the photosensitive drum during one revolution, and changing the angular velocity of the drive motor on the basis of the stored fluctuation information at the timing of a home position signal output with each rotation of the rotary encoder, i.e., executing so-called feedforward control. This technology can eliminate an oscillation phenomenon such as an increase in rotation speed fluctuation which is a concern in feedback control and achieve stable drive control, and therefore can suppress periodic fluctuation in surface moving speed of the photosensitive drum.

Furthermore, Japanese Patent Application Laid-open No. 2010-008924 has disclosed a technology of counting the number of pulses output from a rotary encoder and outputting a timing signal when it comes to a pulse count corresponding to one revolution of the rotary encoder, thereby detecting a home position signal.

In this manner, to perform feedforward control on the basis of fluctuation information detected in advance based on a preset home position on a rotating shaft is effective as a method to suppress periodic fluctuation in surface moving speed of a photosensitive drum.

However, in such a conventional image forming apparatus using feedforward control based on a home position in each rotation of a rotary encoder (in each rotation of a photosensitive drum), a period of fluctuation to be corrected is limited to only an integral period with respect to a rotation period of the photosensitive drum.

Therefore, if a reduction gear with a non-integral reduction gear ratio, for example, a planetary gear mechanism is adopted, there is a problem that there exist gears with a non-integral ratio or non-terminating decimal ratio of rotation period, and fluctuation cannot be corrected on the basis of the home position in each rotation of the photosensitive drum.

As a means for feedforward control of gears with a non-integral ratio or non-terminating decimal ratio of rotation period, for example, a home position could be set on each gear.

However, this configuration has a problem that a component for detecting a home position of each gear has to be installed, which results in an increase in the number of parts and an increase in cost.

There have been needs to solve these problems and to provide a rotating-body driving device capable of performing feedforward control enabling, even when a reduction gear having gears that each rotate with a non-integral ratio of rotation period to a rotation period of a shaft of a photosensitive drum is used in a drive transmission system of the photosensitive drum, to suppress periodic fluctuation generated with the respective rotation periods of the gears.

SUMMARY OF THE INVENTION

It is an object of the present invention to at least partially solve the problems in the conventional technology.

According to an aspect of the invention, a rotating-body driving device is provided. The rotating-body driving device includes: a rotating body; a driving source that generates a driving force for rotating the rotating body; a reduction gear that includes an output shaft connected to the rotating body and a gear rotating at a non-integer ratio of rotation period to a rotation period of the output shaft, and the reduction gear reducing rotation speed of the driving source with the gear and transmitting the driving force to the rotating body via the output shaft; a pulse-signal generating unit that generates a pulse signal associated with the number of revolutions of the output shaft; a pulse-count storage unit that accumulates and stores therein the number of pulse signals generated by the pulse-signal generating unit; a speed-fluctuation storage unit that stores therein a rotation speed fluctuation of the output shaft occurring every rotation period of the gear as speed fluctuation information associated with the number of pulse signals; and a driving-source control unit that controls the driving source, wherein the driving-source control unit detects the speed fluctuation information associated with the accumulated number of pulse signals from the speed-fluctuation storage unit on the basis of the accumulated number of pulse signals stored in the pulse-count storage unit, and performs for the driving source a feedforward control using the speed fluctuation information to set off the rotation speed fluctuation.

According to another aspect of the invention, an image forming apparatus is provided. The image forming apparatus includes: the rotating-body driving device; and an image forming unit that transfers the image carried on the photosensitive drum onto a recording medium, thereby forming the image on the recording medium.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a diagram showing gear specifications of a planetary gear mechanism according to the embodiment of the present invention;

FIG. 7 is a diagram showing rotation fluctuation components of the planetary gear mechanism according to the embodiment of the present invention;

DETAILED DESCRIPTION OF THE PREFERRED EMBODIMENTS

Exemplary embodiments of the present invention will be explained below with reference to accompanying drawings.

FIGS. 1 to 11 are diagrams illustrating an embodiment of a rotating-body driving device and an image forming apparatus according to the present invention, and shows a case where the rotating-body driving device according to the present invention is applied to an electrophotographic color multi-function peripheral (hereinafter, referred to as an "MFP") as an example of the image forming apparatus.

First, a configuration of the MFP is explained.

Figure 1:
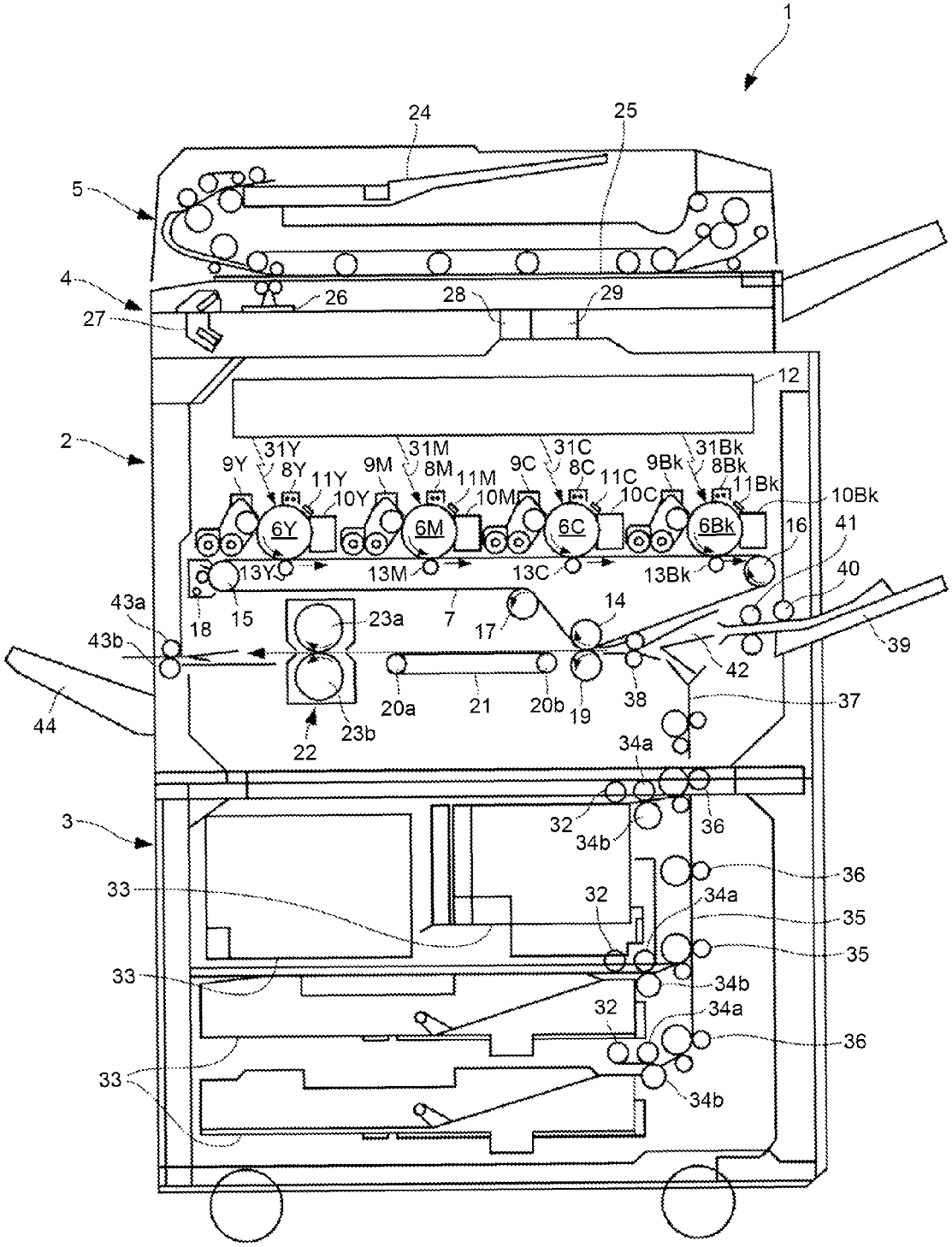
FIG. 1 is a cross-sectional view illustrating an outline of a copier according to an embodiment of the present invention.

FIG. 1 is a diagram illustrating a configuration of an MFP 1 according to the present embodiment. The MFP 1 is a so-called tandem type of image forming apparatus, and adopts a dry two-component developing method using dry two-component developer. In FIG. 1, the MFP 1 includes an MFP main body 2, a sheet feeder 3, a scanner 4, and an automatic document feeder 5 as image forming means.

In the MFP 1, the MFP main body 2 is set up on top of the sheet feeder 3, and the scanner 4 is installed on top of the MFP main body 2, and the automatic document feeder 5 is installed on top of the scanner 4.

The MFP 1 receives image data which is information on a scanned image from the scanner 4 or receives print data from an external device, such as a personal computer, and performs an image forming process.

The MFP main body 2 includes four photosensitive drums 6Y, 6M, 6C, and 6Bk (for yellow (Y), magenta (M), cyan (C), and black (Bk) color images) provided as rotating bodies. The photosensitive drums 6Y, 6M, 6C, and 6Bk are driven bodies and cylindrical latent-image carriers.

Furthermore, the MFP main body 2 includes, as members for an electrophotographic process, charging units 8Y, 8M, 8C, and 8Bk, developing units 9Y, 9M, 9C, and 9Bk, cleaning units 10Y, 10M, 10C, and 10Bk, and neutralization lamps 11Y, 11M, 11C, and 11Bk around the photosensitive drums 6Y, 6M, 6C, and 6Bk in the order of the process.

The MFP main body 2 includes an optical writing device 12 above the photosensitive drums 6Y, 6M, 6C, and 6Bk. Furthermore, the MFP main body 2 includes primary transfer rollers 13Y, 13M, 13C, and 13Bk, which are primary transfer means, in positions opposed to the photosensitive drums 6Y, 6M, 6C, and 6Bk across an intermediate transfer belt 7.

The photosensitive drums 6Y, 6M, 6C, and 6Bk have contact with the intermediate transfer belt 7 which is an endless belt supported by multiple rotatable rollers including a drive roller, and are arranged side-by-side along a moving direction of the intermediate transfer belt 7.

The intermediate transfer belt 7 is supported by support rollers 14 and 15, a drive roller 16, and a tension roller 17, and is driven to rotate by rotation of the drive roller 16 driven to rotate by a driving source (not shown).

A belt cleaning unit 18 is installed in a position opposed to the support roller 15 across the intermediate transfer belt 7, and removes residual toner remaining on the intermediate transfer belt 7 after secondary transfer.

The support roller 14 is an opposed secondary transfer roller opposed to a secondary transfer roller 19 which is a secondary transfer means. A secondary transfer nip portion is formed between the support roller 14 and the secondary transfer roller 19 across the intermediate transfer belt 7.

A transfer-sheet conveyance belt 21 is supported by support rollers 20*a* and 20*b*, and is installed on the downstream side of the secondary transfer nip portion in a transfer-sheet conveying direction. The transfer-sheet conveyance belt 21 conveys a transfer sheet onto which a toner image has been secondary-transferred to a fixing unit 22.

The fixing unit 22 includes fixing rollers 23*a* and 23*b*, and fixes an unfixed toner image on a transfer sheet by applying heat and pressure to the transfer sheet at a fixing nip portion formed by abutting contact between the fixing rollers 23*a* and 23*b*.

Subsequently, a copy operation of the MFP is explained.

When a user forms a full-color image with use of the MFP 1 according to the present embodiment, first, the user sets an original on an original table 24 of the automatic document feeder 5. Or, the user opens the automatic document feeder 5 and sets an original on a platen glass 25 of the scanner 4, and closes the automatic document feeder 5 to cover it.

After that, if the user pushes a START switch (not shown), the original is conveyed onto the platen glass 25 in the case where the original has been set in the automatic document feeder 5. When the original has been on the platen glass 25, first and second traveling bodies 26 and 27 of the scanner 4 start traveling.

A light from the first traveling body 26 is reflected by the original on the platen glass 25, and the reflected light is further reflected by a mirror of the second traveling body 27 and is guided into a read sensor 29 through an imaging lens 28, thereby the scanner 4 scans image information of the original.

Furthermore, when the user has pushed the START switch, the MFP main body 2 drives a motor (not shown), thereby driving the drive roller 16 to rotate, so that the intermediate transfer belt 7 is driven to move by the rotation of the drive roller 16.

Furthermore, at the same time that the intermediate transfer belt 7 is driven to move, a photoreceptor driving device 30Y (not shown) as a rotating-body driving device to be described later drives the photosensitive drum 6Y to rotate in a direction of arrow, and the rotating photosensitive drum 6Y is uniformly charged by the charging unit 8Y.

After that, the optical writing device 12 emits an optical beam 31Y to the photosensitive drum 6Y, and a Y electrostatic latent image is formed on the photosensitive drum 6Y. The Y electrostatic latent image is developed into a Y-toner image by transfer of Y toner contained in developer applied by the developing unit 9Y.

At the developing, a predetermined developing bias is applied to between a developing roller and the photosensitive drum 6Y, and Y toner on the developing roller is electrostatically-transferred onto the Y electrostatic latent image on the photosensitive drum 6Y.

In accordance with the rotation of the photosensitive drum 6Y, the Y-toner image formed on the photosensitive drum 6Y is conveyed to a primary transfer position at which the photosensitive drum 6Y has contact with the intermediate transfer belt 7. At the primary transfer position, the primary transfer roller 13Y applies a predetermined bias voltage to the back side of the intermediate transfer belt 7.

Then, by a primary-transfer electric field generated by the application of the bias voltage, the Y-toner image is attracted to the side of the intermediate transfer belt 7, and is primary-transferred onto the intermediate transfer belt 7.

Likewise, an M-toner image, a C-toner image, and a Bk-toner image are sequentially primary-transferred onto the intermediate transfer belt 7 so as to be superimposed on the Y-toner image. Incidentally, residual toner remaining on the intermediate transfer belt 7 after secondary transfer is removed by the belt cleaning unit 18.

Moreover, when the user has pushed the START switch, the sheet feeder 3 rotates a sheet feed roller 40 corresponding to transfer paper that the user has selected, and sends transfer sheets out from one of sheet cassettes 33.

The sent transfer sheets are separated one by one by separation rollers 34*a* and 34*b* and sequentially fed into a sheet feed path 35, and conveyed to a sheet feed path 37 in the MFP main body 2 by a conveyance roller 36. The conveyed transfer sheet is stopped by bumping against a registration roller 38.

When transfer sheets which have not set in any of the sheet cassettes 33 are used, the MFP main body 2 sends transfer sheets set in a manual feed tray 39 by means of the sheet feed roller 32. The sent transfer sheets are separated one by one by a separation roller 41, and sequentially conveyed to the registration roller 38 through a manual feed path 42.

The superimposed four-color toner image on the intermediate transfer belt 7 is conveyed to a secondary transfer position opposite to the secondary transfer roller 19 in accordance with the movement of the intermediate transfer belt 7. Furthermore, the registration roller 38 starts rotating in keeping with the timing at which the compound toner image formed on the intermediate transfer belt 7 is conveyed to the secondary transfer position, and conveys the transfer sheet to the secondary transfer position.

Then, at the secondary transfer position, the secondary transfer roller 19 applies a predetermined bias voltage to the back side of the transfer sheet. By a secondary-transfer electric field generated by the application of the bias voltage and a contact pressure at the secondary transfer position, the toner image on the intermediate transfer belt 7 is secondary-transferred onto the transfer sheet.

The transfer sheet onto which the toner image has been secondary-transferred is conveyed to the fixing unit 22 by the transfer-sheet conveyance belt 21. Here, the fixing unit 22 performs a process of fixing the toner image on the transfer sheet by means of the fixing rollers 23*a* and 23*b* included in the fixing unit 22.

After the fixing process, the transfer sheet is discharged and stacked on a copy receiving tray 44 installed outside of the MFP 1 by sheet discharge rollers 43*a* and 43*b*.

Subsequently, a configuration of a rotating-body driving device including a reduction gear is explained. Incidentally, the photosensitive drums 6Y, 6M, 6C, and 6Bk, which are driven bodies, are driven to rotate by photoreceptor driving devices 30Y, 30M, 30C, and 30Bk having the same configuration; therefore, in the explanation described below, alphabetic color codes Y, M, C, and Bk are omitted.

As a reduction gear with a non-integral reduction gear ratio, a reduction gear using a gear train with a non-integral ratio of the number of gear teeth is commonly used.

By adopting a reduction gear using a gear train with a non-integral ratio of the number of gear teeth, the range of options for reduction gear ratios is expanded, and an optimum reduction gear, ratio can be set according to output characteristics, such as the number of revolutions and efficiency of the motor.

Furthermore, by adopting a reduction gear using a gear train with a non-integral ratio of the number of gear teeth, engagement of teeth between gears varies with each rotation, and therefore it is possible to prevent uneven wear.

In the photoreceptor driving device 30 according to the present embodiment, as a reduction gear using a gear train with a non-integral ratio of the number of gear teeth, a planetary reduction, gear capable of enhancing the durability, the miniaturization, and the high precision in addition to the above effects is used.

FIGS. 2 to 5 are diagrams showing a configuration of the photoreceptor driving device 30. The photoreceptor driving device 30 includes a motor 45 as a driving source, a planetary reduction gear 46 as a reduction gear and a planetary gear mechanism, a joint 47, and a drum shaft 48.

Figure 2:
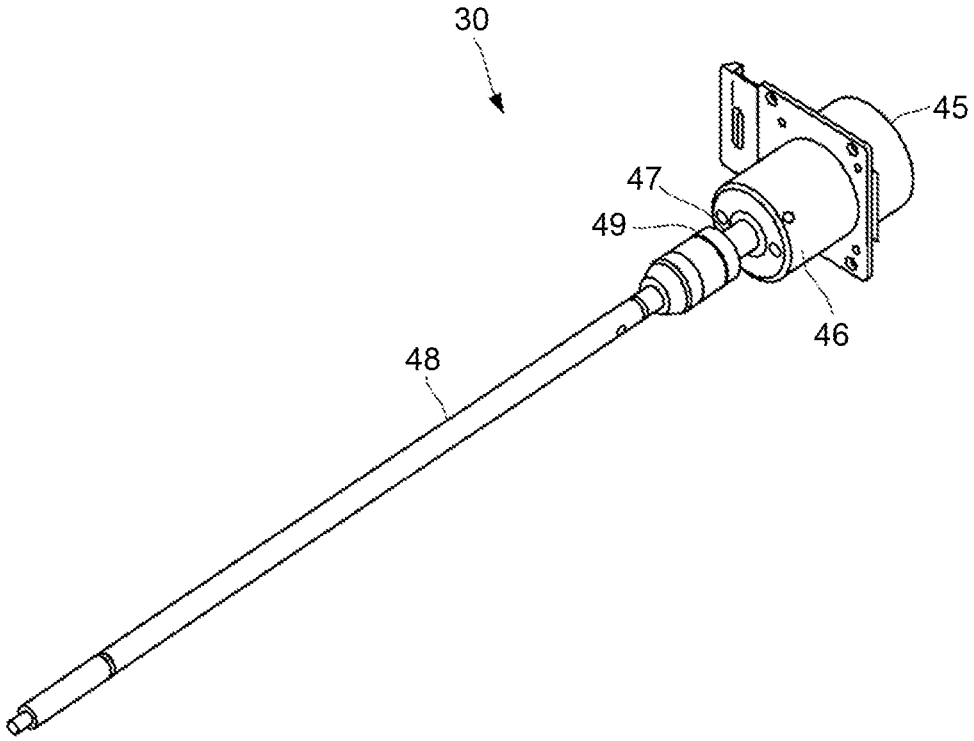
FIG. 2 is a schematic perspective view illustrating a photoreceptor driving device according to the embodiment of the present invention.
Figure 3:
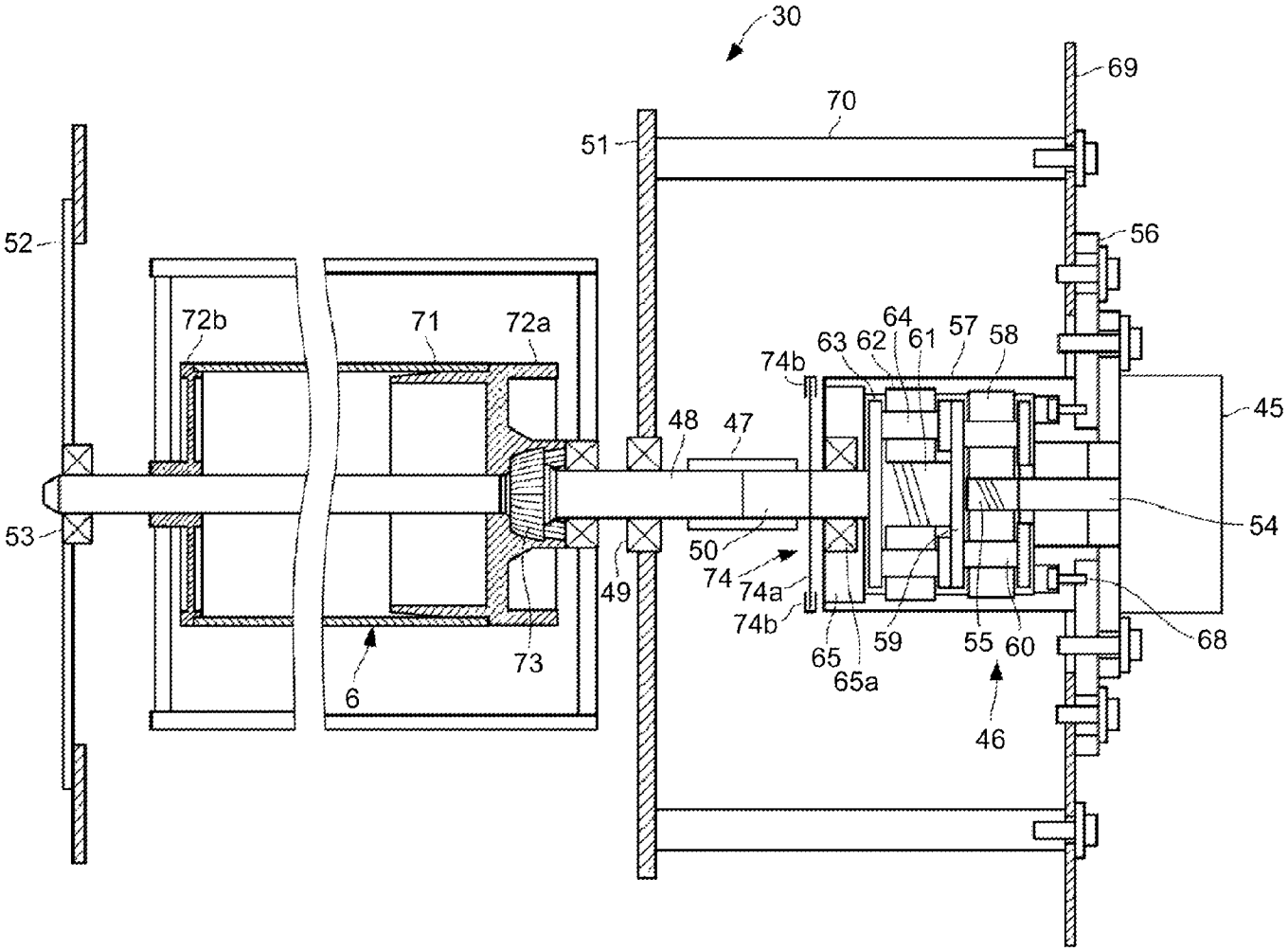
FIG. 3 is a cross-sectional view of the photoreceptor driving device according to the embodiment of the present invention.

As shown in FIGS. 2 and 3, an output shaft 50 of the planetary reduction gear 46 is connected and fixed to the drum shaft 48 by the joint 47. Furthermore, in the photoreceptor driving device 30, a bearing 49 is press-fitted in the drum shaft 48.

A near-tip portion of the drum shaft 48 of the photoreceptor driving device 30 is fitted in a bearing 53 installed on a front side plate 52, which is a front-side main body side plate fixed to a housing of the MFP main body 2. Furthermore, the photoreceptor driving device 30 is installed on a back side plate 51, which is a back-side main body side plate fixed to the housing of the MFP main body 2, via the bearing 49.

Namely, the photoreceptor driving device 30 is supported and positioned by being installed on the front and back side plates 52 and 51, which are part of the housing of the MFP main body 2, via the bearings 53 and 49 of the drum shaft 48.

In the planetary reduction gear 46 according to the present embodiment, a 2K-H type two-stage planetary gear mechanism is used. In general, a planetary reduction gear is composed of four parts: a sun gear, planetary gears, a planetary carrier which supports the revolution of the planetary gears, and an outer gear. In the 2K-H type planetary gear mechanism, a shaft of the sun gear, a shaft of the planetary carrier, and a shaft of the outer gear are basic shafts.

The 2K-H type planetary gear mechanism has three elements: rotation of the sun gear, rotation of the planetary gears (rotation of the planetary carrier), and rotation of the outer gear, and any one of the three elements is fixed, another one is connected to input, and the remaining one is connected to output.

The 2K-H type planetary gear mechanism can switch a reduction gear ratio and a rotation direction by which of fixed, input, and output are the three elements assigned to, respectively; therefore, switching of multiple reduction gear ratios and rotation directions can be achieved by one unit.

A reduction gear ratio of the 2K-H type two-stage planetary gear mechanism is calculated by the following equation (1), where Za denotes the number of teeth of the sun gear, Zb denotes the number of teeth of the planetary gear, and Zc denotes the number of teeth of the outer gear. Incidentally, suffixes 1 and 2 in the equation (1) denote the first stage and the second stage, respectively.

$$\text{Reduction gear ratio} = \frac{Z_{a1}}{Z_{a1} + Z_{c1}} \times \frac{Z_{a2}}{Z_{a2} + Z_{c2}} \quad (1)$$

The 2K-H type two-stage planetary gear mechanism according to the present embodiment is categorized as a compound planetary gear mechanism (of two or more 2K-H type planetary gear mechanisms), and the shaft of the sun gear is set as an input shaft, the shaft of the outer gear is set as a fixed shaft, and the shaft of the planetary carrier is set as an output shaft.

In FIG. 3, a first-stage planetary gear mechanism of the planetary reduction gear 46 includes a first sun gear 55, an outer gear 57, first planetary gears 58, a first carrier 59, and a first carrier pin 60. The outer gear 57 is integrally formed with an outer gear of a second-stage planetary gear mechanism.

To reduce the number of components, the first sun gear 55 is formed by directly cutting a portion of a motor output shaft 54 which is a drive shaft of the motor 45.

The first planetary gears 58 engage with the first sun gear 55 and the outer gear 57 fixed to a bracket 56, and revolve along an outer periphery of the first sun gear 55 while being supported by the first carrier 59.

For the sake of rotational balance and torque sharing, the first planetary gears 58 are arranged in equally-spaced positions where the first carrier 59 is concentrically divided into three equal parts in a circumferential direction. The first planetary gears 58 each rotate while being supported by the first carrier pin 60 installed on the first carrier 59.

By engagement with the first sun gear 55 and the outer gear 57, the first planetary gears 58 rotate and revolve. This reduces the rotation of the first carrier 59 supporting the first planetary gears 58 to lower speed than the first sun gear 55, and thus a first-stage reduction gear ratio is acquired.

Incidentally, the first carrier 59 has no rotation support part, and is configured to rotate in a floating state.

The second-stage planetary gear mechanism of the planetary reduction gear 46 includes a second sun gear 61, the outer gear 57, second planetary gears 62, a second carrier 63, a second carrier pin 64, and the output shaft 50.

To reduce the number of components, the second sun gear 61 is integrally formed with the first carrier 59 in the rotation center of the first carrier 59, and the second sun gear 61 is input of the second-stage planetary gear mechanism.

The second planetary gears 62 engage with the second sun gear 61 and the outer gear 57, and revolve along an outer periphery of the second sun gear 61 while being supported by the second carrier 63.

The second planetary gears 62 are arranged in equally-spaced positions where the second carrier 63 is concentrically divided into three equal parts in a circumferential direction. The second planetary gears 62 each rotate while being supported by the second carrier pin 64 installed on the second carrier 63.

The second carrier 63 rotates in accordance with the rotation and revolution of the second planetary gears 62 driven by engagement with the second sun gear 61 and the outer gear 57. An outer-gear cap 65 is installed in the end of the outer gear 57 on the side of the photosensitive drum 6 so as to cover the carriers and the planetary gears, and a bearing **65*a* is press-fitted in the inside of the outer-gear cap 65**.

The output shaft 50 is installed in the rotation center of the second carrier 63 corresponding to the final stage, and is connected to the drum shaft 48 having the same diameter via the hollow cylindrical joint 47. The output shaft 50 is positioned by the outer gear 57, and is supported by the bearing **65*a* press-fitted in the outer-gear cap 65**.

The outer-gear cap 65 is positioned by being fitted in a groove that has been formed on an inner periphery of the outer gear 57 and has about the same diameter as the outer diameter of the outer-gear cap 65. Consequently, the planetary reduction gear 46 can minimize coaxiality between the output shaft 50 and the central axis of the outer gear 57.

In the photoreceptor driving device 30, the drum shaft 48 and the output shaft 50 are coaxially connected and integrated by the joint 47 which is a connecting member. Here, the joint 47 is configured as shown in FIG. 4.

Figure 4:
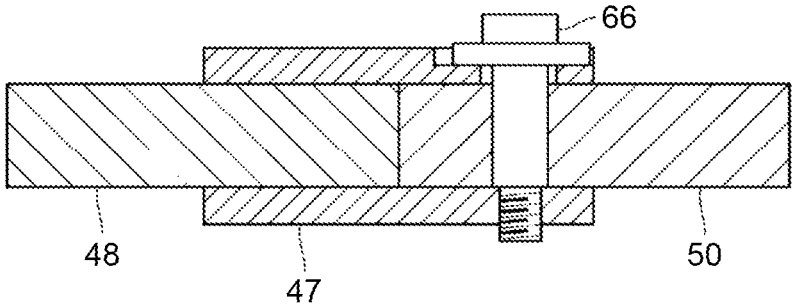
FIG. 4 is a cross-sectional view showing an example of a method for connecting a drum shaft and an output shaft according to the embodiment of the present invention.

As shown in FIG. 4, the joint 47 has a hollow cylindrical shape, and a portion of the joint 47 on the side of the drum shaft 48 is press-fitted in the drum shaft 48. Furthermore, a portion of the joint 47 on the side of the output shaft 50 is loosely fitted in the output shaft 50, and is connected and fixed to the output shaft 50 with a shoulder screw 66.

Alternatively, the joint 47 can be configured as shown in FIG. 5. The joint 47 shown in FIG. 5 has a slit 47*a* in the central part of the hollow cylindrical shape. The output shaft 50 is connected and fixed to the joint 47 by a force due to friction with the joint 47 bent by a screw 67.

In any of the configurations shown in FIGS. 4 and 5, the joint 47 in the present embodiment is preferably configured to minimize misalignment between the central axes of the drum shaft 48 and the output shaft 50 in the joint part and be able to transmit a driving source.

Figure 5A:
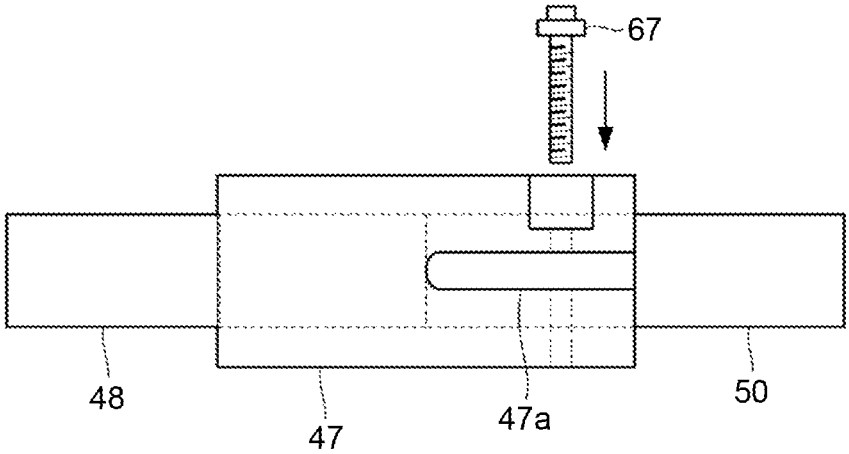
FIG. 5A is a front view showing another example of the method for connecting the drum shaft and the output shaft according to the embodiment of the present invention.
Figure 5B:
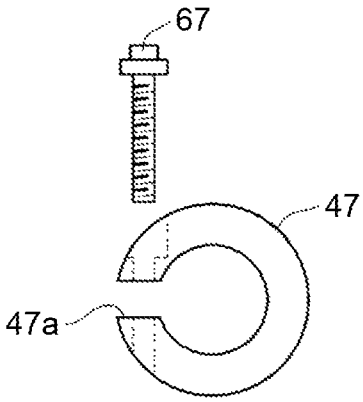
FIG. 5B is a front view of a joint shown in FIG. 5A.

Incidentally, FIG. 5A is a diagram illustrating a method of connecting and fixing the output shaft 50 and the drum shaft 48 by the joint 47; FIG. 5B is a front view of the joint 47 viewed from a direction of the central axis of the output shaft 50.

As shown in FIG. 3, the motor 45 is supported by the bracket 56. Furthermore, the outer gear 57 is fixed to the bracket 56 with screws 68. In this manner, the bracket 56 fixes and holds the motor 45 and the outer gear 57.

The bracket 56 is fixed to a drive side plate 69 with screws. Furthermore, the drive side plate 69 is supported and positioned by studs 70 swaged into the back side plate 51.

A hollow cylindrical boss is formed on the central axis of the outer gear 57 on the side of the motor 45, and the motor 45 is positioned by being fitted in the inner periphery of the boss having about the same diameter as the outer diameter of a bearing installed on the motor 45 side.

The outer gear 57 is configured to be positioned by fitting the outer periphery of the boss in a hole that has been formed on the bracket 56 and has about the same diameter as the outer diameter of the boss.

By such a configuration, the planetary reduction gear 46 can arrange the motor output shaft 54, the bracket 56, and the output shaft 50 so that their central axes are coaxially arranged with reference to the outer gear 57. Furthermore, by the present configuration, the planetary reduction gear 46 can minimize coaxiality due to dimensional variations in parts of the motor output shaft 54, the bracket 56, and the output shaft 50.

Incidentally, in the photoreceptor driving device 30 according to the present embodiment, the first sun gear 55, the first planetary gears 58, the second sun gear 61, and the second planetary gears 62 compose a gear. Incidentally, in the present embodiment, the outer gear 57 is fixed; however, in a case where another rotational element is fixed, the outer gear 57 composes a gear.

Furthermore, in the photoreceptor driving device 30 according to the present embodiment, the first sun gear 55 and the second sun gear 61 compose a sun gear, the first planetary gears 58 and the second planetary gears 62 compose planetary gears, and the first carrier 59 and the second carrier 63 compose a carrier.

The photosensitive drum 6 is composed of a cylindrical drum 71 and drum flanges 72*a* and 72*b*. The drum 71 is configured to be positioned by the drum shaft 48 via the drum flanges 72*a* and 72*b* installed on both ends of the drum 71.

A hole having about the same diameter as the drum shaft 48 is formed on each of the drum flanges 72*a* and 72*b* at the position of the central axis of the drum 71, and the drum 71 is attached to the drum shaft 48 by inserting the drum shaft 48 into the holes, thereby being positioned. Accordingly, the photosensitive drum 6, which is a driven body, is supported and positioned by the housing of the MFP main body 2 via the drum shaft 48.

To transmit a driving force to the drum 71, a joint 73 is press-fitted in the drum shaft 48. The drum 71 is configured to be driven via the drum flange 72*a* connected to the joint 73 by rotation of the joint 73 in accordance with rotation of the drum shaft 48.

A rotary encoder 74 as a pulse-signal generating unit is installed on the output shaft 50. The rotary encoder 74 is a rotation-speed detecting means including an encoder circular plate 74*a* and two sensors 74*b*.

The encoder circular plate 74*a* is attached to the output shaft 50 so as to be mounted coaxially with the central axis of the outer gear 57, the motor output shaft 54, the bracket 56, and the output shaft 50. Furthermore, the encoder circular plate 74*a* is placed on the upstream side of the joint 47 of the output shaft 50 in a driving-force transmitting direction.

Slits are formed on the encoder circular plate 74*a* in a circumferential direction at even intervals, and the sensors 74*b* each optically detect a slit of the encoder circular plate 74*a* and output a detection signal to a controller 75 to be described later.

The two sensors 74*b* detect a slit of the encoder circular plate 74*a* at positions having a phase difference of 180 degrees, respectively; even if the encoder circular plate 74*a* is installed eccentrically to the output shaft 50, the controller 75 averages data detected by the two sensors 74*b*, so that a rotation angular velocity of the output shaft 50 can be detected with high accuracy.

Incidentally, instead of an optical encoder, a magnetic encoder which detects a magnetic mark put on the concentric circle of a disk composed of a magnetic body with a magnetic head can be adopted as the rotary encoder 74. Or, a well-known tacho generator can be used.

As described above, the photoreceptor driving device 30 uses the planetary reduction gear 46, and therefore can suppress rotation fluctuation of the photosensitive drum 6 without installing a large-diameter gear or installing a direct drive motor as a driving source.

Furthermore, the photoreceptor driving device 30 according to the present embodiment can arrange the motor output shaft 54 and integrally-formed first sun gear 55, the outer gear 57, the first carrier 59 and integrally-formed second sun gear 61, the second carrier 63 and integrally-formed output shaft 50, the drum shaft 48, the central axis of the drum 71 composing the photosensitive drum 6, and the encoder circular plate 74*a* all on the same axis.

Consequently, the photoreceptor driving device 30 can minimize coaxiality due to dimensional variations in parts.

Moreover, the photoreceptor driving device 30 is supported in a state where the first carrier 59 floats with respect to the outer gear 57.

Consequently, a concentric error between the first carrier 59 and the outer gear 57 is suppressed by the action of alignment by supporting the photoreceptor driving device 30 in the state where the first carrier 59 floats, and therefore the photoreceptor driving device 30 can further suppress the rotation fluctuation of the photosensitive drum 6.

Furthermore, the photoreceptor driving device 30 includes the rotary encoder 74; therefore, by performing feedback control (hereinafter, referred to as "FB control") of the motor 45, the photoreceptor driving device 30 can further suppress rotation fluctuation of the photosensitive drum 6 resulting from a concentric error caused by an installation error or the like.

Consequently, it is possible to provide the photoreceptor driving device 30 capable of driving the high-accuracy rotation of the photosensitive drum 6 of which the rotation fluctuation is further suppressed.

The first sun gear 55, the first carrier pin 60, the second carrier 63, and the second carrier pin 64 composing the planetary reduction gear 46 are made of metallic material, such as stainless steel or carbon steel.

Furthermore, the first planetary gears 58, the first carrier 59, the second sun gear 61 integrally formed with the first carrier 59, the second planetary gears 62, and the outer gear 57 integrally formed with the housing case are moldings made of resin material, such as polyacetal.

The planetary reduction gear 46 is made of a hybrid of metal and resin as described above; therefore, the metallic output shaft 50 can be integrally provided with the second carrier 63.

In this manner, the output shaft 50 and the second carrier 63 are made of metal; therefore, the output shaft 50 and the second carrier 63 can withstand a high load of the photosensitive drum 6 as compared with a planetary gearbox of which the major components are all made of resin.

Therefore, the planetary reduction gear 46 according to the present embodiment can respond to weight saving and resource saving, and can further withstand high load of the photosensitive drum 6 than a planetary gearbox of which the major components are all made of resin.

In the photoreceptor driving device 30, the drum shaft 48 is rotatably supported by the back side plate 51 via the bearing 49 in a state where a position of the drum shaft 48 in a radial direction is fixed by the back side plate 51 via the bearing 49. Furthermore, in the photoreceptor driving device 30, the outer gear 57 of the planetary reduction gear 46 is also fixed to the back side plate 51 via the bracket 56 and the studs 70.

Therefore, when the photoreceptor driving device 30 is installed in the MFP main body 2, if there is shaft misalignment between the drum shaft 48 and the output shaft 50 of the planetary reduction gear 46, rotation fluctuation resulting from the shaft misalignment may arise.

Consequently, in the planetary reduction gear 46, the outer gear 57, the first planetary gears 58, the second planetary gears 62, the first carrier 59, and the second sun gear 61 integrally formed with the second carrier 63 are made of resin and are configured to be elastically deformable in a radial direction.

Furthermore, by configuring the photoreceptor driving device 30 to be elastically deformable, even in the event of shaft misalignment between the drum shaft 48 and the output shaft 50, the photoreceptor driving device 30 can align the drum shaft 48 and the output shaft 50 by elastic deformation of components configured to be elastically deformable. Consequently, the photoreceptor driving device 30 can drive the photosensitive drum 6 to rotate with high accuracy.

Moreover, the components of the photoreceptor driving device 30 which are configured to be elastically deformable can distribute an elastic deformation amount in the alignment, and therefore can improve the durability of the photoreceptor driving device 30.

Furthermore, by installing the metallic output shaft 50, the photoreceptor driving device 30 can use the joint 47 capable of minimizing misalignment between the central axes of the drum shaft 48 and the output shaft 50 and transmitting a driving force in connection between the drum shaft 48 and the output shaft 50.

Generally, in a photoreceptor driving device of which the major components are all made of resin, for example, a spline joint with backlash is used in connection between a shaft of a driven body and an output unit of a planetary gear mechanism.

However, in the photoreceptor driving device 30 according to the present embodiment, the joint 47 is used to connect and unite the drum shaft 48 and the output shaft 50; therefore, it is possible to eliminate rotation fluctuation caused by backlash.

Furthermore, in the photoreceptor driving device 30, unevenness of rotation between the drum shaft 48 and the output shaft 50 does not occur by installation of the joint 47; therefore, an installation position of the rotary encoder 74 is not limited to the downstream side of the joint 47 in the driving-force transmitting direction.

Therefore, the rotary encoder 74 can be placed on the upstream side of the joint 47 of the output shaft 50 in the driving-force transmitting direction, i.e., in the planetary reduction gear 46.

In this manner, by placing the rotary encoder 74 on the side of the planetary reduction gear 46, mounting of the rotary encoder 74 in the photoreceptor driving device 30 can be achieved without deteriorating assemblability of the photoreceptor driving device 30.

When the rotary encoder 74 is mounted in the photoreceptor driving device 30, for example, the encoder circular plate 74*a* of the rotary encoder 74 is attached to the output shaft 50 of the planetary reduction gear 46 fixed to the bracket 56 together with the motor 45.

Then, the sensors 74*b* of the rotary encoder 74 are attached to the housing case integrated with the outer gear 57, and positions of the encoder circular plate 74*a* and the sensors 74*b* are adjusted and fixed.

Next, the output shaft 50 is integrally connected to the drum shaft 48 by the joint 47. Then, the photoreceptor driving device 30 is implemented in such a manner that the drum shaft 48 is inserted into a hole formed on the back side plate 51, and the planetary reduction gear 46 is inserted into a hole formed on the drive side plate 69, thereby positions of the drum shaft 48 and the planetary reduction gear 46 are adjusted and fixed.

In this manner, the rotary encoder 74 is mounted in the photoreceptor driving device 30, thereby the photoreceptor driving device 30 can drive the photosensitive drum 6 to rotate with high accuracy by FB control using the rotary encoder 74.

Furthermore, by the above-described configuration, the photoreceptor driving device 30 can achieve both resource saving resulting in weight saving and highly-accurate rotary drive of the photosensitive drum 6.

In the MFP main body 2 according to the present embodiment, when the diameter of the photosensitive drum 6 is 60 mm, surface moving speed of the photosensitive drum 6 and conveying speed of the intermediate transfer belt 7 are 350 mm/s, and therefore the number of revolutions of the photosensitive drum 6 is 112 rpm. Incidentally, the diameter of the photosensitive drum 6 is not limited to this.

The photosensitive drum 6 is required to have highly-accurate constant-speed rotational performance; therefore, a motor capable of controlling the rotation speed, such as a DC servomotor or a stepping motor, is adopted as the motor 45. The motor 45 according to the present embodiment is composed of an outer rotor type DC brushless motor with stable rotation characteristics and low power consumption.

To efficiently rotate the outer rotor type DC brushless motor that outputs about 20 to 30 W to drive the photosensitive drum 6 or a transfer belt, it is preferable that the outer rotor type DC brushless motor is driven to rotate at about 2400 to 3600 rpm.

Therefore, the planetary reduction gear 46 is required to reduce the number of revolutions of the output shaft 50 to one twentieth to thirtieth of the number of revolutions of the motor output shaft 54.

Furthermore, in the layout of the photoreceptor driving device 30, space conservation can be achieved by eliminating constraints of interference with a development driving device and a toner supply unit around the photosensitive drum 6 and placing a driving device near the side plate of the photosensitive drum 6.

Therefore, when a reduction gear using a large-diameter gear, for example, a gear having the substantially larger diameter than that of the photosensitive drum 6 is adopted, the reduction gear has to be installed by displacing either the large-diameter gear or a development driving device in an axial direction of the photosensitive drum 6 for avoiding interference with the development driving device.

Furthermore, there exists a large unutilized region (dead space) around the large-diameter gear. This leads to increases in size and cost of the entire device.

Therefore, in the photoreceptor driving device 30 according to the present embodiment, the 2K-H type two-stage planetary reduction gear 46 is adopted as a reduction gear to achieve the requirements of a reduction gear ratio of 20 to 30 and the outer diameter of 60 mm.

FIG. 6 is a diagram showing gear specifications of the planetary reduction gear 46 according to the present embodiment. In the planetary reduction gear 46, a first-stage reduction gear unit on the side of the motor 45, which is a driving source, is the input side, and a second-stage reduction gear unit on the side of the photosensitive drum 6, which is an object to be driven, is the output side.

A reduction gear ratio of the input side is 7.08, and a reduction gear ratio of the output side is 4.16, and the total reduction gear ratio of the planetary reduction gear 46 is 29.4. Furthermore, the planetary reduction gear 46 is configured so that a root circle diameter of the outer gear 57 is about 33.3 mm and an outer diameter is not more than 50 mm.

Generally, in a planetary gear mechanism, if both have the same outer diameter, one having a smaller reduction gear ratio than the other is lower in load torque acting on a gear engagement part. Therefore, reduction gear ratios of the input side and the output side are preferably set so that the reduction gear ratio of the output side on which load torque largely acts is smaller than that of the input side to improve the durability of the planetary gear mechanism.

In the planetary reduction gear 46, an integrally-molded gear shared by the input side and the output side is adopted as the outer gear 57 to reduce the cost. Therefore, in the planetary reduction gear 46, to increase the reduction gear ratio of the input side, the number of teeth of the first sun gear 55 is 13 which is fewer than 25 teeth of the output-side second sun gear 61.

Generally, in a planetary reduction gear, two or more planetary gears are arranged at equal spaces. The planetary reduction gear 46 includes three first planetary gears 58 and three second planetary gears 62.

Furthermore, to improve the rotation accuracy, the number of teeth of a sun gear is preferably the non-integral multiple of the number of teeth of a planetary gear.

Therefore, in the planetary reduction gear 46 according to the present embodiment, the number of teeth of the first sun gear 55 is set to 13, and the number of teeth of the second sun gear 61 is set to 25 so that the number of teeth of the first and second sun gears 55 and 61 are the non-integral multiple of the number of (three) teeth of the first and second planetary gears 58 and 62, respectively.

Consequently, the timing for each of the three first planetary gears 58 and the three second planetary gears 62 to engage with the first sun gear 55 and the second sun gear 61 is out of synchronization, so engagement vibration generated due to a difference in tooth pitch between engagement parts causes a phase difference between the first planetary gears 58 and the second planetary gears 62, and this reduces the vibration.

Furthermore, the first and second planetary gears 58 and 62 according to the present embodiment have an odd number of teeth (the first planetary gear 58 has 13 teeth, and the second planetary gear 62 has 25 teeth).

Consequently, the first planetary gears 58 generate a phase difference between engagement vibration generated due to the tooth pitch of an engagement part engaged with the first sun gear 55 and engagement vibration generated due to the tooth pitch of an engagement part engaged with the outer gear 57, and therefore reduces the vibration.

Therefore, the rotation accuracy of the first planetary gears 58 is improved. The second planetary gears 62 can also achieve the same effect, and the rotation accuracy of the second planetary gears 62 is improved.

Incidentally, to further reduce engagement vibration generated due to a difference in tooth pitch between engagement parts of gears, helical gears are adopted as gears of the planetary reduction gear 46, and the face width and helix angle are set so that a tooth contact ratio is 3 or higher.

Consequently, respective reduction gear ratios of the input and output sides of the planetary reduction gear 46 determined by the number of teeth of gears shown in FIG. 6 are both a non-integral and non-terminating decimal reduction gear ratio.

Incidentally, generally, there are many design examples of planetary gear mechanisms where even if the number of gear teeth as described above is not selected, and a reduction gear ratio is an integral ratio, a rotation period of a planetary gear shows a non-integral ratio to a rotation period of a carrier which is an output shaft.

FIG. 7 is a diagram showing generated frequencies of major fluctuation components periodically generated due to rotation-speed fluctuation factors which are components of the planetary reduction gear 46 when the photosensitive drum 6 is driven at 1 Hz.

Incidentally, in the following explanation, parts composing the planetary reduction gear 46 are rotation fluctuation factors, and major fluctuation components periodically generated due to the rotation fluctuation factors are rotation fluctuation components.

The rotation fluctuation factors of the planetary reduction gear 46 include one tooth contacts of the first sun gear 55, the second sun gear 61, the first planetary gears 58, the second planetary gears 62, the first carrier 59, and the second carrier 63, and exist in both the first and second stages.

A rotation fluctuation component generated with a rotation period of the first sun gear 55 in the first stage is generated due to rotation fluctuation of the motor 45 and gear accuracy of the first sun gear 55 formed by cutting a portion of the motor output shaft 54.

A rotation fluctuation component generated with a rotation period of the first planetary gears 58 in the first stage is generated due to gear accuracy of the first planetary gears 58.

A rotation fluctuation component generated with a rotation period of the first carrier 59 which is the first-stage output is generated due to part accuracy of the first carrier 59 and gear accuracy of the second sun gear 61 integrally molded with the first carrier 59.

A rotation fluctuation component generated with a rotation period of the second sun gear 61 in the second stage is generated due to part accuracy of the first carrier 59 and gear accuracy of the second sun gear 61 integrally molded with the first carrier 59.

A rotation fluctuation component generated with a rotation period of the second planetary gears 62 in the second stage is generated due to gear accuracy of the second planetary gears 62.

A rotation fluctuation component generated with a rotation period of the second carrier 63 which is the second-stage output is generated due to part accuracy of the second carrier 63.

Furthermore, a rotation fluctuation component generated with a period of one tooth contact in each stage is generated due to tooth form accuracy of each gear.

In an image forming apparatus, a high degree of rotation accuracy is required; therefore, it is necessary to take a measure to suppress the fluctuation in all of these rotation fluctuation factors.

Therefore, in the photoreceptor driving device 30 according to the present embodiment, rotation fluctuation components of the gears and carrier in each stage that are fluctuations in a low-frequency band of 50 Hz or less indicated by bold font in FIG. 7 are controlled by feedforward control (hereinafter, referred to as "FF control") which is rotation control of the motor 45.

Furthermore, in the photoreceptor driving device 30 according to the present embodiment, a fluctuation component generated with a period of one tooth contact that is a fluctuation in a high-frequency band of 50 Hz or more indicated by regular font in FIG. 7 is reduced by choice of the number of gear teeth.

The fluctuation component generated with the period of one tooth contact, which is difficult to suppress by the control rotation control of the motor 45, is suppressed by setting the number of teeth of the first and second sun gears 55 and 61 to be the non-integral multiple of the number of teeth of the first and second planetary gears 58 and 62, respectively, and setting the number of teeth of the planetary gears to be odd numbers as shown in FIG. 6.

As a result, the fluctuation component generated with the period of one tooth contact is reduced; however, the fluctuations of the rotation fluctuation factors subject to the FF control are generated at a non-integral and non-terminating decimal ratio to a rotation period of the drum shaft 48 (a rotation period of the second carrier 63).

Therefore, the photoreceptor driving device 30 cannot set a home position on the drum shaft 48 and therefore cannot perform the FF control according to an amount of previously-detected fluctuation.

Consequently, the photoreceptor driving device 30 according to the present embodiment performs the FF control based on accumulated pulse count of the rotary encoder 74 without using a home position, thereby suppressing the fluctuations of the rotation fluctuation factors.

Figure 8:
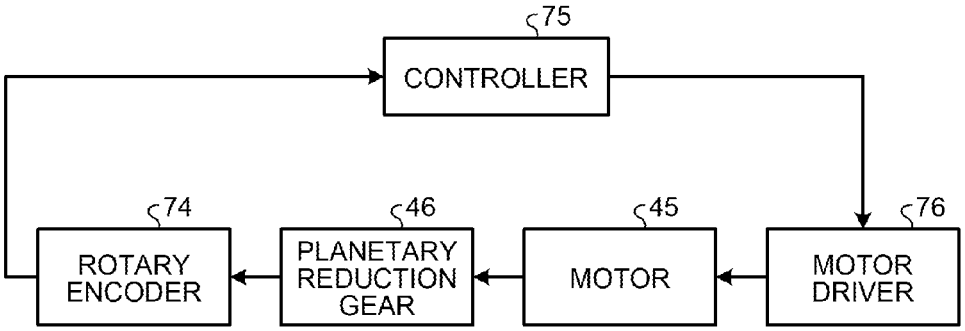
FIG. 8 is a schematic diagram of a control system according to the embodiment of the present invention.

FIG. 8 shows an outline of a control system of the photoreceptor driving device 30 according to the present embodiment. In FIG. 8, configurations of the motor 45, the planetary reduction gear 46, and the rotary encoder 74 are as described above.

The rotary encoder 74 transmits a pulse signal according to a rotation amount of the output shaft of the planetary reduction gear 46 to the controller 75 serving as a pulse-number storage unit and a speed-fluctuation storage unit.

The controller 75 measures a time interval between pulse signals transmitted from the rotary encoder 74, and calculates the current rotation speed of the output shaft 50, and performs FB control for controlling the rotation speed of the motor 45 so that the rotation speed of the output shaft 50 becomes a target value.

Furthermore, the controller 75 previously detects a rotation fluctuation component for which the time interval between pulse signals periodically fluctuates, and performs the FF control at predetermining timing.

Then, a motor driver 76 drives the motor 45 in accordance with a motor-speed command value transmitted from the controller 75.

Figure 9:
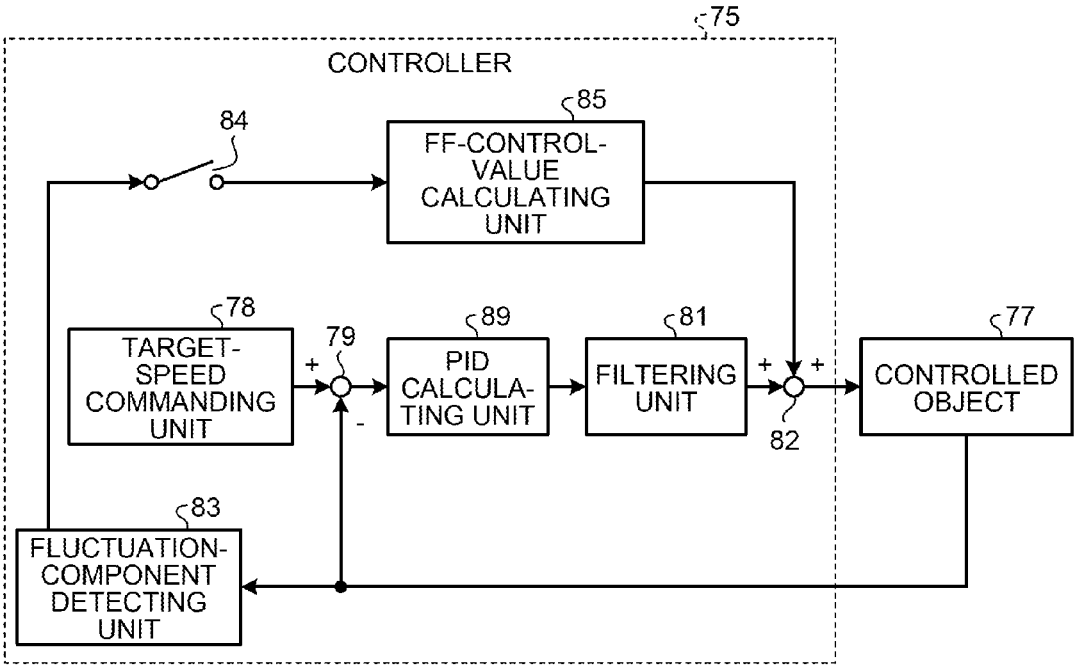
FIG. 9 is a block diagram illustrating the control system according to the embodiment of the present invention.

FIG. 9 is a block diagram for explaining a control system of the controller 75.

The present control system includes an FB control system designed for a controlled object 77 including the motor driver 76 and the rotary encoder 74.

Furthermore, the present control system further includes an FF control system in addition to the FB control system. The FF control system adds an FF control value to an output unit of the FB control system (a motor-speed command value). The FF control value here means a motor-speed command value output from the FF control system.

The FB control system performs control for suppressing rotation fluctuation caused by a non-periodic change in load on the drum shaft 48 by means of various parts having abutting contact with the photosensitive drum 6.

In the FB control system, the controller 75 obtains speed information from a signal output from the rotary encoder 74. Then, the controller 75 causes a comparator 79 to calculate speed deviation information, which is a difference between speed information and target speed information, on the basis of the speed information and target speed information obtained from a target-speed commanding unit 78.

Then, the controller 75 causes a PID calculating unit 89 to calculate a motor-speed command value from the speed deviation information calculated by the comparator 79.

Then, the controller 75 causes a filtering unit 81 to filter the motor-speed command value calculated by the PID calculating unit 89. This filtering is performed to stabilize the FB control system while maintaining a control area of the FB control system.

The photoreceptor driving device 30 according to the present embodiment is a two-inertia system in which the motor 45 and the photosensitive drum 6 are inertia fields, and therefore, vibration is likely to be generated at a resonance point.

Consequently, to prevent excitation of resonant vibration due to driving of the motor of the FB control system, the filtering unit 81 adopts a quaternary Butterworth filter as a low-pass filter.

The controller 75 executes the FB control system with a control period of 1 msec, thereby suppressing various disturbance fluctuations and controlling the photosensitive drum 6 to rotate at the target speed constantly.

In FIG. 9, the FF control system is composed of a fluctuation-component detecting unit 83, a switch 84, and an FF-control-value calculating unit 85, and is configured to add a result of calculation by the FF control system to the FB control system.

The FB control system is executed with the control period of 1 msec, whereas in the FF control system, operations of the fluctuation-component detecting unit 83 and the switch 84 are executed with a period of a few seconds. Then, the FF-control-value calculating unit 85 calculates a numerical value by performing multi-sampling with a period two to three times longer than the control period of the FB control system.

Subsequently, operation of the controller 75 in the FF control system is explained.

First, in a state where the switch 84 is OFF, the controller 75 causes the fluctuation-component detecting unit 83 to detect fluctuation information as speed fluctuation information included in rotation fluctuation components of the first planetary gears 58, the second planetary gears 62, the first carrier 59, and the second carrier 63 from pulse signals transmitted from the rotary encoder 74. The fluctuation information here means data on the amplitude and phase of a rotation fluctuation component.

Then, the controller 75 turns the switch 840N, and transfers the fluctuation information detected by the fluctuation-component detecting unit 83 to the FF-control-value calculating unit 85. Then, after the transfer of the fluctuation information, the controller 75 turns the switch 84 OFF, and causes the FF-control-value calculating unit 85 to calculate an FF control value, which offsets the fluctuation, on the basis of the fluctuation information and a current drum rotation phase.

Then, in a state where the switch 84 is OFF, the controller 75 causes an adder 82 to add the FF control value calculated by the FF-control-value calculating unit 85 to control output of the FB control system.

Consequently, the controller 75 can compensate only a disturbance caused by an objective periodic fluctuation in the form of FF control without disturbing closed-loop characteristics of the FB control system.

The planetary reduction gear 46 according to the present embodiment is a gear reducer, and therefore a relationship between the rotation periods of the gears is unchanged. A fluctuation of a rotation fluctuation factor to be suppressed occurs with a fixed period as shown in FIG. 7 with respect to the rotation of the output shaft 50 to which the rotary encoder is attached.

Therefore, on the assumption that this periodic fluctuation is sinusoidal, a disturbance estimation observer is installed, and the fluctuation-component detecting unit 83 periodically detects a disturbance estimate, i.e., respective fluctuation information of rotation fluctuation components by using this observer.

By turning the switch 84 OFF, fluctuation information used by the FF-control-value calculating unit 85 is updated during the estimation of a disturbance by the fluctuation-component detecting unit 83, thereby preventing the disturbance being estimated from being changed.

Consequently, the fluctuation information of the FF-control-value calculating unit 85 is updated during the estimation of a disturbance by the fluctuation-component detecting unit 83, and therefore the controller 75 can avoid a change in the estimate disturbance estimated by the fluctuation-component detecting unit 83 and significant reduction of the FF control accuracy.

The FF-control-value calculating unit 85 calculates an FF control value for fluctuation offset with a period close to the control period of the FB control system in consideration of a function of transfer from control input to signal output of the encoder (a function of sensitivity to an input disturbance).

Incidentally, in the photoreceptor driving device 30 according to the present embodiment, the fluctuation-component detecting unit 83, the switch 84, and the FF-control-value calculating unit 85 compose an updated-speed-fluctuation storage unit.

Figure 10:
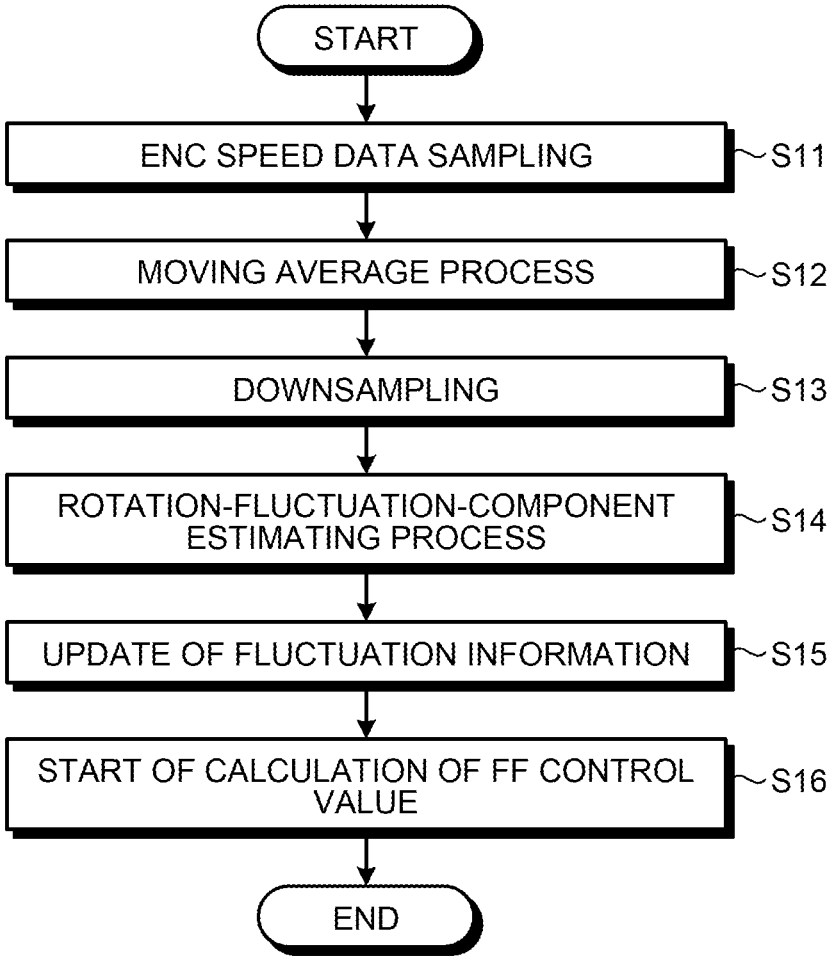
FIG. 10 is a flowchart illustrating a process performed by a feedforward control system according to the embodiment of the present invention.

FIG. 10 is a flowchart of major steps of the operation of the FF control system shown in the block diagram of FIG. 9.

In FIG. 10, Steps S11 to S14 are executed by the fluctuation-component detecting unit 83, Step S15 is executed by the FF-control-value calculating unit 85 when the switch 84 has been turned ON, and Step S16 is subsequently executed by the FF-control-value calculating unit 85.

To perform FF control, learning action of detecting a rotation fluctuation and management of a phase of the photosensitive drum 6 are required. By using these, the FF-control-value calculating unit 85 can calculate a sinusoidal FF control value that is opposite in amplitude value but the same in phase with respect to the detected periodic fluctuation and execute the FF control.

Consequently, to manage the phase of the photosensitive drum 6, the controller 75 includes a phase-management pulse counter that accumulatively counts the number of pulses transmitted from the rotary encoder 74.

The pulse counter starts counting at the time of startup of the motor 45.

After completion of the startup of the motor 45, the fluctuation-component detecting unit 83 starts sampling of encoder speed data (hereinafter, referred to as "ENC speed data sampling") as the first operation of the FF control system (Step S11). At the start of the ENC speed data sampling, the controller 75 stores therein a phase-management pulse count value C1.

Then, the fluctuation-component detecting unit 83 performs a moving average process on the sampled data stored at Step S11, thereby removing a noise component in a higher frequency band than a component of a periodic fluctuation to be detected (Step S12). The moving average process here is a process of summing all the stored sampled data and dividing the sum by the number of the sampled data.

Then, the fluctuation-component detecting unit 83 performs downsampling of data to be stored in a memory as frequently as every 10 outputs at Step S12 (Step S13). Through Step S13, the fluctuation-component detecting unit 83 can reduce a calculation load of a rotation-fluctuation-component estimating process to be subsequently performed.

After completion of the storage of the downsampled data, the fluctuation-component detecting unit 83 performs a process of estimating rotation fluctuation components of the first and second sun gears 55 and 61 and rotation fluctuation components of the first and second planetary gears 58 and 62 that are included in the downsampled data (Step S14). The estimating process here is to calculate estimated fluctuation data from each rotation fluctuation component.

Rotation fluctuation components subject to the estimating process include the rotation fluctuation components generated in the first sun gear 55, the first planetary gears 58, the second sun gear 61 integrally formed with the first carrier 59, and the second planetary gears 62. Generation of these fluctuation components has already been predicted in assessment of a prototype, and therefore, these fluctuation components have been set as objects of the estimating process.

Incidentally, a rotation fluctuation component of the second carrier 63 is expected to get a sufficient effect of control by the FB control system and therefore is excluded from an object of the estimating process performed by the FF control system.

In the rotation-fluctuation-component estimating process, the fluctuation-component detecting unit 83 performs a matrix operation on each of the rotation fluctuation components by using an estimated fluctuation coefficient matrix set in advance, and calculates an in-phase component (I component) and quadrature component (Q component) of each of the rotation fluctuation components.

After completion of the rotation-fluctuation-component estimating process, the fluctuation-component detecting unit 83 calculates fluctuation information from estimated fluctuation data created through the rotation-fluctuation-component estimating process. Then, the switch 84 is turned ON, the fluctuation information is transmitted to the FF-control-value calculating unit 85. The FF-control-value calculating unit 85 updates the fluctuation information saved therein with the phase component and quadrature component of the received fluctuation information (Step S15).

Then, the FF-control-value calculating unit 85 calculates a phase value of each of the rotation fluctuation components from the updated fluctuation information and the pulse count value C1 at the start of the ENC speed data sampling and a current pulse count value of the phase-management pulse counter. Then, the FF-control-value calculating unit 85 starts calculation of an FF control value (Step S16).

Incidentally, the pulse counter used for phase management is an accumulation counter, so there is a concern about overflow. As the timing to reset the accumulation counter in order to avoid overflow, the start of the ENC speed data sampling is preferably adopted so that all it takes is changing only the phase of the FF-control-value calculating unit 85.

To improve the FF control accuracy, and respond to temporal changes of components of the planetary reduction gear 46, and correct a phase management error caused by miscounting of the pulse counter, the controller 75 repeatedly executes the control mode shown in FIG. 10. This repeatedly-performed control mode is hereinafter referred to as a "constant learning type".

In the constant learning type, the fluctuation information is constantly updated to the latest fluctuation information, and the FF-control-value calculating unit 85 calculates an FF control value on the basis of the updated fluctuation information.

Figure 11:
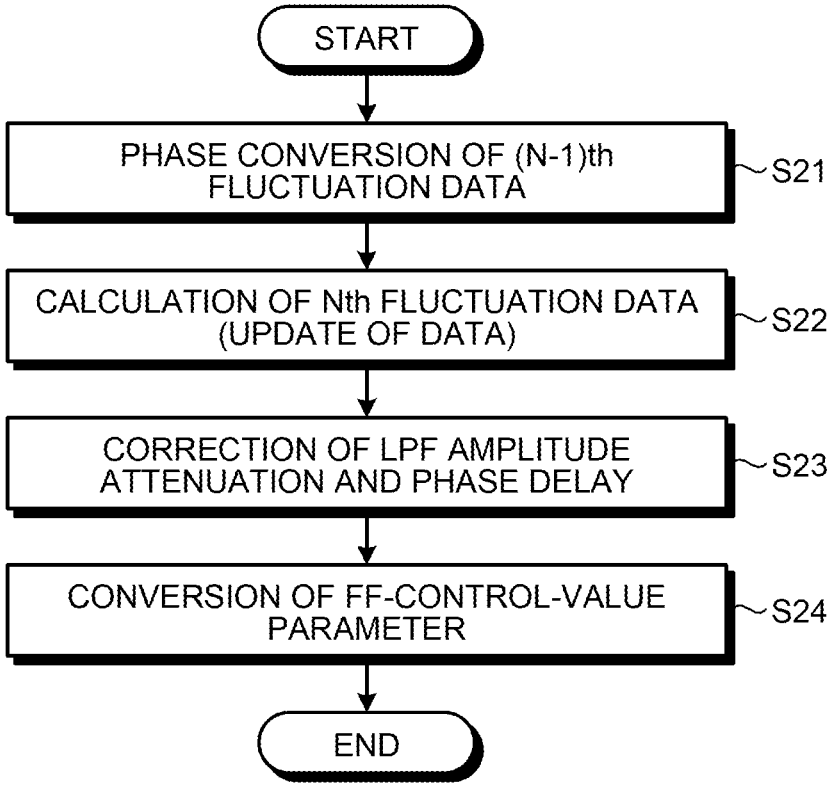
FIG. 11 is a flowchart illustrating a process of updating a control value of feedforward control according to the embodiment of the present invention.

FIG. 11 is a diagram showing details of the processes performed by the FF-control-value calculating unit 85 at Steps S15 and S16 in FIG. 10 after the switch 84 is turned ON in the constant learning type.

Each time the ON-OFF operation of the switch 84 is repeated by the execution of FF control action by the controller 75, the FF-control-value calculating unit 85 acquires fluctuation information as a learning value. Here, the following value is acquired as a learning value.

For example, a first learning value acquired through the first FF control action is fluctuation information acquired when the motor 45 is driven at constant speed.

Furthermore, a second learning value acquired through the second FF control action is fluctuation information acquired when the motor 45 is driven by an FF control value calculated from the first learning value.

The FF-control-value calculating unit 85 acquires a learning value in accordance with the ON operation of the switch 84 each time the controller 75 executes the FF control action. Namely, an Nth learning value acquired through the Nth FF control action is fluctuation information acquired when the motor 45 is driven by an FF control value calculated from an (N−1)th learning value. Therefore, fluctuation information is updated on the basis of Nth acquired fluctuation information and (N−1)th updated fluctuation information.

At Step S21 in FIG. 11, the timing at which an Nth learning value was acquired (a phase of each rotation fluctuation component) is different from the timing at which an (N−1)th learning value was acquired, so the FF-control-value calculating unit 85 performs a phase correction.

The phase correction here is a process of correcting the phase component and quadrature component of each rotation fluctuation component calculated at Step S14 to an appropriate value to be handled at Step S22.

This converts the (N−1)th fluctuation information into the same phase as the Nth learning timing on the basis of a difference value between the (N−1)th and Nth pulse count values.

Then, the FF-control-value calculating unit 85 updates the fluctuation information (Step S22). An update-value calculation formula is expressed by the following equation (2).

$$N\text{th fluctuation information (update value)}=(N-1)\text{th fluctuation information (previous update value)}-N\text{th fluctuation information (}N\text{th learning value)} \quad (2)$$

By subtracting the Nth fluctuation information from the (N−1)th fluctuation information, a reversed-phase component that the Nth detected rotation fluctuation component is inverted is added to the (N−1)th fluctuation information as an FF-control-value calculating parameter.

Then, the FF-control-value calculating unit 85 corrects attenuation (smoothing) of the amplitude and delay in phase of each rotation fluctuation component due to the moving average process at Step S12 (Step S23). Then, the FF-control-value calculating unit 85 converts the Nth fluctuation information (update value) on the basis of an attenuation rate and an amount of phase delay of each rotation fluctuation component.

Then, the FF-control-value calculating unit 85 calculates an FF control value from fluctuation information derived by the update of the Nth fluctuation information. The FF-control-value calculating unit 85 calculates an FF control value by calculating a current phase from a current pulse count value based on the pulse count value C1 of the phase-management pulse counter at the start of the ENC speed data sampling (Step S24).

In this manner, by adopting the constant learning type, the controller 75 can use characteristics of FF control and FB control. Therefore, if the process shown in FIGS. 10 and 11, which is performed with the constant learning type control period, is performed with a shorter period, the controller 75 generates mutual interference between the constant learning type and the existing FB control.

Consequently, the constant learning type control period of the FF control has to be a sufficiently long period with respect to the control period of the FB control, and is preferably more than 100 times longer than the control period of FB control. In the controller 75 according to the present embodiment, the FB control is performed with the control period of 1 msec, whereas the constant learning type control period of the FF control, i.e., an update period of fluctuation information is a period of 0.5 to 3 msec.

FIG. 12 is a diagram showing results of Verification of the suppressing effects on rotation fluctuation due to the FF control and FB control according to the present embodiment obtained by analyzing a rate of rotation speed fluctuation of the photosensitive drum 6 using a fast Fourier transform (FFT) method.

In FIG. 12, the photosensitive drum 6 is driven at 1.8 Hz, and fluctuation components shown are all primary components.

Figure 12A:
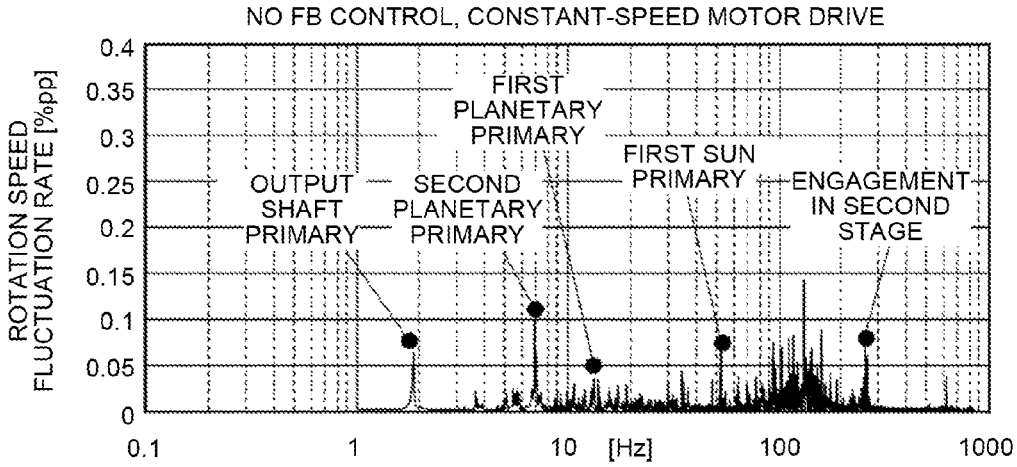
FIG. 12A is a diagram showing results of implementation of the control system according to the embodiment of the present invention in the photoreceptor driving device.

FIG. 12A is a diagram showing a rotation speed fluctuation rate due to each rotation fluctuation factor when the motor 45 is controlled to be driven at constant speed by output (a motor FG signal) from a rotation detector mounted on the motor output shaft 54.

As can be seen from FIG. 12A, in the photoreceptor driving device 30, the output shaft 50 ("output shaft primary" in FIG. 12) and the first planetary gears 58 ("first planetary primary" in FIG. 12) have fluctuation in rotation speed with their respective rotation periods. Furthermore, in the photoreceptor driving device 30, the second planetary gears 62 ("second planetary primary" in FIG. 12) and the first sun gear 55 ("first sun primary" in FIG. 12) have fluctuation in rotation speed with their respective rotation periods.

Figure 12B:
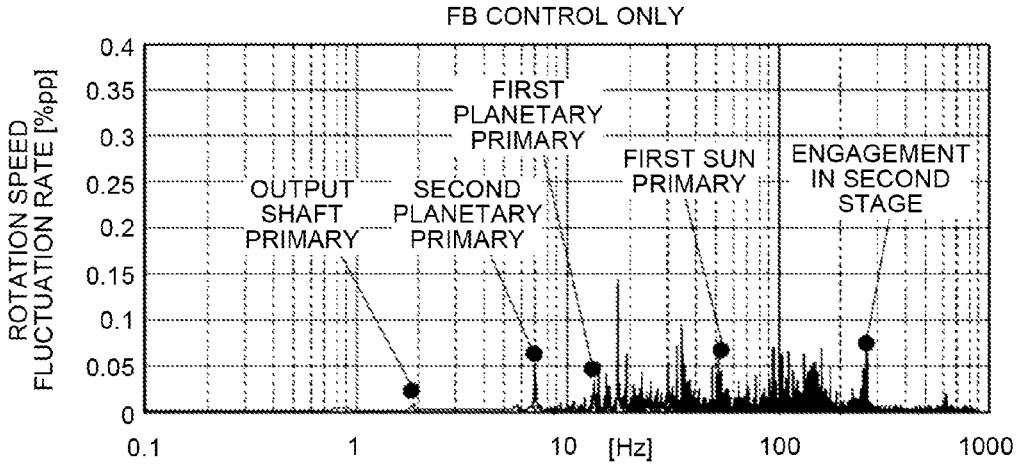
FIG. 12B is a diagram showing results of implementation of the control system according to the embodiment of the present invention in the photoreceptor driving device.

FIG. 12B is a diagram showing a rotation speed fluctuation rate due to each rotation fluctuation factor when driving of the motor 45 is FB-controlled by the FB control system using output from the rotary encoder 74 installed on the output shaft 50.

As can be seen from FIG. 12B, in the photoreceptor driving device 30, rotation speed fluctuation generated with rotation periods of the output shaft 50 and the second planetary gears 62, which belong to a low-frequency band of 10 Hz or less, is suppressed by performing the FB control.

Figure 12C:
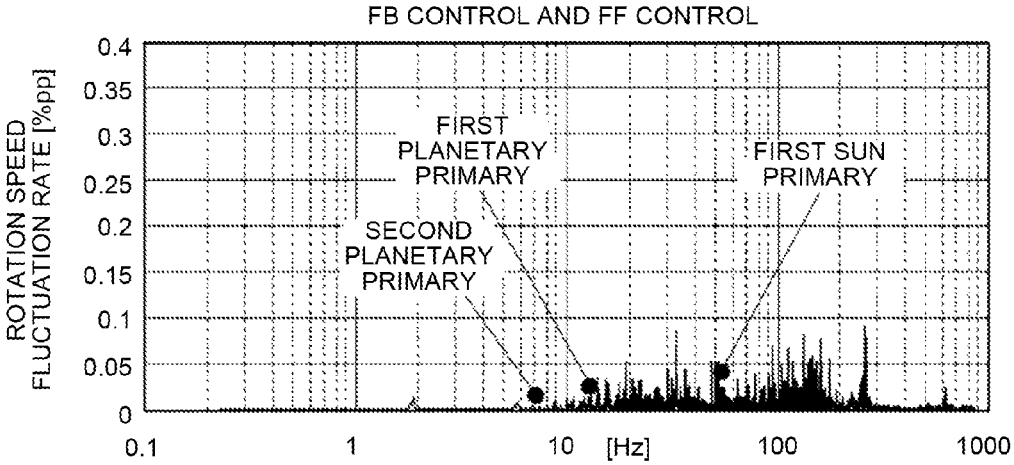
FIG. 12C is a diagram showing results of implementation of the control system according to the embodiment of the present invention in the photoreceptor driving device.

FIG. 12C is a diagram showing a rotation speed fluctuation rate due to each rotation fluctuation factor when control of the FF control as well as the FB control, which is a control form of the photoreceptor driving device 30 according to the present embodiment, is executed.

As can be seen from FIG. 12C, in the photoreceptor driving device 30, rotation speed fluctuation generated with rotation periods of the first planetary gears 58 and the first sun gear 55, which belong to a high-frequency band of 10 Hz or more, is suppressed by performing the FF control.

As described above, the photoreceptor driving device 30 according to the present embodiment includes the photosensitive drum 6, the motor 45 that generates a driving force for driving the photosensitive drum 6 to rotate, the output shaft 50 connected to the photosensitive drum 6, and the planetary reduction gear 46 that includes the first sun gear 55, the first planetary gears 58, the second sun gear 61, and the second planetary gears 62, which each rotate with a non-integral ratio of rotation period to a rotation period of the output shaft 50, and reduces the rotation speed of the motor 45 and transmits the driving force to the photosensitive drum 6 via the output shaft 50.

The photoreceptor driving device 30 according to the present embodiment further includes the rotary encoder 74, which generates a pulse signal according to the number of revolutions of the output shaft 50, and the controller 75, which accumulates and stores the number of pulse signals generated by the rotary encoder 74, and stores rotation speed fluctuation of the output shaft 50 generated with each of the rotations periods of the first sun gear 55, the first planetary gears 58, the second sun gear 61, and the second planetary gears 62 as fluctuation information corresponding to the number of pulse signals, and controls the rotation speed of the motor 45.

The controller 75 is configured to detect fluctuation information corresponding to the number of accumulated pulse signals and execute FF control of driving the motor 45 so as to offset the rotation speed fluctuation of the output shaft 50 by using the fluctuation information.

Therefore, the photoreceptor driving device 30 can suppress the periodic rotation fluctuation of the output shaft 50 caused by the rotation of the gears of the planetary reduction gear 46 by the FF control without using a home position sensor in each gear.

Furthermore, the photoreceptor driving device 30 according to the present embodiment is configured so that the number of teeth of the first and second sun gears 55 and 61 are the non-integral multiple of the number of (three) teeth of the first and second planetary gears 58 and 62, respectively.

Consequently, the photoreceptor driving device 30 can stagger the engagement timing between the three first planetary gears 58 engaged with the first sun gear 55 and the three second planetary gears 62 engaged with the second sun gear 61. Therefore, engagement vibration generated due to a difference in tooth pitch between engagement parts causes a phase difference between the planetary gears, so that the vibration of the photoreceptor driving device 30 can be reduced.

Moreover, in the photoreceptor driving device 30 according to the present embodiment, the number of teeth of the first planetary gears 58 and the number of teeth of the second planetary gears 62 are set to odd numbers, respectively.

Consequently, the first planetary gears 58 can generate a phase difference between engagement vibration generated due to the tooth pitch of an engagement part engaged with the first sun gear 55 and engagement vibration generated due to the tooth pitch of an engagement part engaged with the outer gear 57, and therefore can reduce the vibration.

Therefore, the rotation accuracy of the first planetary gears 58 can be improved. Furthermore, the second planetary gears 62 can also achieve the same effect, and the rotation accuracy of the second planetary gears 62 can be improved.

Furthermore, in the photoreceptor driving device 30 according to the present embodiment, the controller 75 detects rotation speed fluctuation of the output shaft 50 generated with each of the rotations periods of the first sun gear 55, the first planetary gears 58, the second sun gear 61, and the second planetary gears 62 on the basis of detected pulse signals from the rotary encoder 74 during the execution of the FF control, and stores the rotation speed fluctuation in the fluctuation-component detecting unit 83, the switch 84, and the FF-control-value calculating unit 85 as fluctuation information.

Then, the controller 75 updates the fluctuation information stored in the fluctuation-component detecting unit 83, the switch 84, and the FF-control-value calculating unit 85 on the basis of the fluctuation information stored in the fluctuation-component detecting unit 83, the switch 84, and the FF-control-value calculating unit 85 during the execution of the previous FF control and the fluctuation information stored in the fluctuation-component detecting unit 83, the switch 84, and the FF-control-value calculating unit 85 during the execution of the current FF control, and performs the FF control of driving the motor 45 so as to offset the rotation speed fluctuation by using the fluctuation information stored in the fluctuation-component detecting unit 83, the switch 84, and the FF-control-value calculating unit 85.

Consequently, the controller 75 can repeatedly improve the FF control accuracy, and respond to temporal changes of components of the planetary reduction gear 46, and correct a phase management error caused by miscounting of the pulse counter.

Moreover, in the photoreceptor driving device 30 according to the present embodiment, the controller 75 is configured to perform the FB control for controlling the rotation speed of the motor 45 with the control period of 1 msec on the basis of a pulse signal transmitted from the rotary encoder 74.

Consequently, the controller 75 can suppress rotation fluctuation caused by a non-periodic change in load on the drum shaft 48 by means of various parts having abutting contact with the photosensitive drum 6.

Furthermore, in the photoreceptor driving device 30 according to the present embodiment, the controller 75 again detects rotation speed fluctuation of the output shaft 50 after the update of the fluctuation information stored in the fluctuation-component detecting unit 83, the switch 84, and the FF-control-value calculating unit 85.

Consequently, the controller 75 can update the fluctuation information of the FF-control-value calculating unit 85 while the fluctuation-component detecting unit 83 is estimating a disturbance, and therefore can prevent an estimate disturbance estimated by the fluctuation-component detecting unit 83 from being changed, thereby resulting in significant reduction of the FF control accuracy.

Moreover, in the photoreceptor driving device 30 according to the present embodiment, the controller 75 updates the fluctuation information stored in the fluctuation-component detecting unit 83, the switch 84, and the FF-control-value calculating unit 85 with a period more than 100 times longer than the control period of 1 msec.

Consequently, the controller 75 can prevent mutual interference between the constant learning type having characteristics of FB control and the existing FB control.

Incidentally, in the present embodiment, the photoreceptor driving device 30 is applied to a drive shaft of the photosensitive drum 6; however, the present invention is not limited to this, and the photoreceptor driving device 30 can be used as a roller driving device of the drive roller 16 and a rotating-body driving device of each drive roller in a secondary transfer drive unit and a fixing drive unit, etc.

Furthermore, in the present embodiment, the number of the first planetary gears 58 and the number of the second planetary gears 62 are both three; however, the number of the planetary gears is not limited to three, and can be any number as long as there are two or more planetary gears.

In a planetary gear mechanism, both have the same outer diameter and reduction gear ratio, one having more planetary gears than the other is lower in load torque acting on a gear engagement part. Therefore, to further improve the durability while curbing an increase in cost, the number of planetary gears can be, for example, two on the input side and four on the output side.

Furthermore, in the present embodiment, the photosensitive drum 6 and the planetary reduction gear 46 are separate components; however, the present invention is not limited to this configuration, and part or all of the planetary reduction gear 46 can be housed in the photosensitive drum 6.

Moreover, in the present embodiment, the first sun gear 55, the first carrier pin 60, the second carrier 63, and the second carrier pin 64 are made of metal, and the other components of the planetary reduction gear 46 are made of resin; however, the present invention is not limited to this.

For example, the outer gear 57 can be made of resin, and the first planetary gears 58, the second planetary gears 62, the first carrier pin 60, and the second sun gear 61 integrally formed with the first carrier 59 can be made of metal as needed.

Even in this case, the planetary reduction gear 46 can be made lighter than that of which the major components are all made of metal, and can further withstand high load of the photosensitive drum 6 than that of which the major components are all made of resin.

According to the present invention, it is possible to provide a rotating-body driving device capable of performing feedforward control enabling, even when a reduction gear having gears that each rotate with a non-integral ratio of rotation period to a rotation period of a shaft of a photosensitive drum is used in a drive transmission system of the photosensitive drum, to suppress periodic fluctuation generated with the respective rotation period of the gears.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A rotating-body driving device comprising:

a rotating body;

a driving source that generates a driving force for rotating the rotating body;

a reduction gear that includes an output shaft connected to the rotating body and a gear rotating at a non-integer ratio of rotation period to a rotation period of the output shaft, and the reduction gear reducing rotation speed of the driving source with the gear and transmitting the driving force to the rotating body via the output shaft;

a pulse-signal generating unit that generates a pulse signal associated with a rotational amount of the output shaft of the reduction gear;

a pulse-count storage unit that accumulates and stores therein the number of pulse signals generated by the pulse-signal generating unit;

a speed-fluctuation storage unit that stores therein a rotation speed fluctuation of the output shaft occurring every rotation period of the reduction gear as speed fluctuation information associated with the number of pulse signals; and a driving-source control unit that controls the driving source, wherein the driving-source control unit detects the speed fluctuation information of the reduction gear associated with the accumulated number of pulse signals from the speed-fluctuation storage unit on the basis of the accumulated number of pulse signals stored in the pulse-count storage unit, and performs for the driving source a feedforward control using the speed fluctuation information to set off the rotation speed fluctuation.

2. The rotating-body driving device set forth in claim 1, wherein the reduction gear comprises a planetary gear mechanism, the planetary gear mechanism including:

a sun gear;

an outer gear placed coaxially to the sun gear;

multiple planetary gears engaging with both the sun gear and the outer gear, and the multiple planetary gears rotating and revolving around the sun gear; and a carrier supporting the multiple planetary gears.

3. The rotating-body driving device set forth in claim 2, wherein the number of teeth of the sun gear is the non-integer multiple of the number of teeth of the planetary gears included in the planetary gear mechanism.

4. The rotating-body driving device set forth in claim 2, wherein the number of teeth of the planetary gears is an odd number.

5. The rotating-body driving device set forth in claim 1, wherein the driving-source control unit:

detects the rotation speed fluctuation of the output shaft occurring every rotation periods of the gear on the basis of detected pulse signals from the pulse-signal generating unit during the feedforward control being performed, and stores the rotation speed fluctuation in an update-speed-fluctuation storage unit as speed fluctuation information associated with the number of the pulse signals;

updates the speed fluctuation information stored in the update-speed-fluctuation storage unit on the basis of speed fluctuation information stored in the update-speed-fluctuation storage unit during the previous feedforward control and the speed fluctuation information stored in the update-speed-fluctuation storage unit during the current feedforward control; and performs for the driving source a feedforward control using the speed fluctuation information stored in the update-speed-fluctuation storage unit to set off the rotation speed fluctuation.

6. The rotating-body driving device set forth in claim 5, wherein the driving-source control unit performs the feedback control for controlling the rotation speed of the driving source in a predetermined control period on the basis of a pulse signal transmitted from the pulse-signal generating unit.

7. The rotating-body driving device set forth in claim 6, wherein the driving-source control unit detects the rotation speed fluctuation of the output shaft again after updating the speed fluctuation information stored in the update-speed-fluctuation storage unit.

8. The rotating-body driving device set forth in claim 6, wherein the driving-source control unit updates the speed fluctuation information stored in the update-speed-fluctuation storage unit in a period not less than 100 times longer than the control period.

9. The rotating-body driving device set forth in claim 1, wherein the rotating body comprises a photosensitive drum that carries an image on an outer circumferential surface thereof.

10. An image forming apparatus comprising:

the rotating-body driving device set forth in claim 9; and an image forming unit that transfers the image carried on the photosensitive drum onto a recording medium, thereby forming the image on the recording medium.

* * * * *